US010441118B2

(12) United States Patent
Hamajima et al.

(10) Patent No.: US 10,441,118 B2
(45) Date of Patent: Oct. 15, 2019

(54) TOILET SEAT AND METHOD OF MANUFACTURING SAME

(71) Applicant: LIXIL Corporation, Tokyo (JP)

(72) Inventors: Akitaka Hamajima, Tokyo (JP); Yudai Morikawa, Tokyo (JP); Motoki Kagawa, Tokyo (JP); Toshiaki Ikeda, Tokyo (JP); Ryuichi Yokoi, Tokyo (JP); Kouta Higuchi, Tokyo (JP); Ryosuke Nakamura, Tokyo (JP); Ryosuke Suzuki, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 15/755,058

(22) PCT Filed: Aug. 23, 2016

(86) PCT No.: PCT/JP2016/074520
§ 371 (c)(1),
(2) Date: Feb. 23, 2018

(87) PCT Pub. No.: WO2017/033928
PCT Pub. Date: Mar. 2, 2017

(65) Prior Publication Data

US 2018/0220857 A1 Aug. 9, 2018

(30) Foreign Application Priority Data

Aug. 27, 2015 (JP) ..... 2015-168306

(51) Int. Cl.
*A47K 13/00* (2006.01)

(52) U.S. Cl.
CPC ..... *A47K 13/00* (2013.01)

(58) Field of Classification Search
CPC ..... A47K 13/00
(Continued)

(56) References Cited

U.S. PATENT DOCUMENTS 8,091,154 B2 * 1/2012 Allen ..... A47K 13/12 4/234

FOREIGN PATENT DOCUMENTS

JP 63-105724 5/1988
JP 2002-509 1/2002
(Continued)

OTHER PUBLICATIONS

International Search Report and Written Opinion dated Nov. 8, 2016, directed to International Application No. PCT/JP2016/074520; 19 pages.
(Continued)

*Primary Examiner* — Lauren A Crane
(74) *Attorney, Agent, or Firm* — Morrison & Foerster LLP

(57) ABSTRACT

Provided is a method of manufacturing a toilet seat that is formed by joining together a seat front member and a seat rear member. The method includes a cutting step of forming a processed surface of a joint part between the seat front member and the seat rear member by cutting the joint part between the seat front member and the seat rear member with a cutting tool having a curved cutting blade part such that the shape of the processed surface is formed in a curved shape in which the seat rear member side thereof protrudes outward in a cross section perpendicular to the direction in which the joint part extends.

2 Claims, 7 Drawing Sheets

(58) Field of Classification Search
USPC ..... 4/237, 645
See application file for complete search history.

(56) References Cited

FOREIGN PATENT DOCUMENTS

| | | |
|---|---|---|
| JP | 3478934 | 12/2003 |
| JP | 2010-99275 | 5/2010 |
| JP | 2011-25612 | 2/2011 |

OTHER PUBLICATIONS

Examination Report dated Sep. 28, 2017, directed to TW Application No. 105127252; 6 pages.

* cited by examiner

TOILET SEAT AND METHOD OF MANUFACTURING SAME

This application is a national stage application under 35 USC 371 of International Application No. PCT/JP2016/074520, filed Aug. 23, 2016, which claims the priority of Japanese Application No. 2015-168306, filed Aug. 27, 2015, the entire contents of each of which are incorporated herein by reference.

FIELD OF THE INVENTION

The present invention relates to a toilet seat and a method of manufacturing the same.

BACKGROUND OF THE INVENTION

Conventionally, as a method of manufacturing a toilet seat formed by joining a seat front member and a seat rear member together, there is a known method of manufacturing a toilet seat in which after a seat front member and a seat rear member are welded to form a joint part, and the joint part is cut and polished using paper, etc., thereby forming a processed surface (for example, see Patent Document 1).

Patent Document 1: Japanese Unexamined Patent Application, Publication No. 2010-99275

SUMMARY OF THE INVENTION

In the method of manufacturing the toilet seat described in Patent Document 1, the joint part between the seat front member and the seat rear member is processed to form a processed surface in two steps corresponding to a cutting step of cutting the joint part and a polishing step of polishing a cut part, and thus the number of man hours taken to form the processed surface is prone to increase.

In addition, in the toilet seat described in Patent Document 1, the processed surface of the joint part between the seat front member and the seat rear member has a lot of opportunities to come into contact with a hand of a user, and thus is desired to have a smooth shape.

Therefore, there is a desire for a toilet seat which can reduce the number of man hours taken to process a joint part between a seat front member and a seat rear member and has a smooth shape in the joint part between the seat front member and the seat rear member, and a method of manufacturing the same.

An object of the invention is to provide a toilet seat which can reduce the number of man hours taken to process a joint part between a seat front member and a seat rear member and has a smooth shape in the joint part between the seat front member and the seat rear member, and a method of manufacturing the same.

The present invention relates to a method of manufacturing a toilet seat formed by joining a seat front member and a seat rear member together. The method includes a cutting step of forming a processed surface of a joint part between the seat front member and the seat rear member by cutting the joint part between the seat front member and the seat rear member using a cutting tool including a curved cutting blade part such that a shape of the processed surface is formed in a curved shape in which a side of the seat rear member protrudes outward in a cross section perpendicular to a direction in which the joint part extends.

It is preferable that the cutting step includes forming the processed surface by cutting the joint part between the seat front member and the seat rear member using a cutting tool including a linear cutting blade part such that the shape of the processed surface of the joint part between the seat front member and the seat rear member is formed in a linear shape on a side of the seat front member in the cross section perpendicular to the direction in which the joint part extends.

It is preferable that the seat rear member has a protrusion protruding from a seat rear portion of the seat rear member included in a rear surface of the toilet seat, and the curved cutting blade part is formed such that an end of the curved cutting blade part on a side of the protrusion is away from an end of the protrusion on a side of the processed surface by 10 mm or more during the cutting step.

The present invention also relates to a toilet seat including: a seat front member; a seat rear member; and a joint part between the seat front member and the seat rear member, and in which a shape of a processed surface of the joint part between the seat front member and the seat rear member is formed in a curved shape that protrudes outward on a side of the seat rear member and formed in a linear shape on a side of the seat front member in a cross section perpendicular to a direction in which the joint part extends.

It is preferable that the seat rear member has a protrusion protruding from a seat rear portion of the seat rear member included in a rear surface of the toilet seat, and an end of the processed surface on a side of the seat rear member is away from an end of the protrusion on a side of the processed surface by 10 mm or more.

According to the invention, it is possible to provide a toilet seat which can reduce the number of man hours taken to process a joint part between a seat front member and a seat rear member and has a smooth shape in the joint part between the seat front member and the seat rear member, and a method of manufacturing the same.

DETAILED DESCRIPTION OF THE INVENTION

Figure 1:
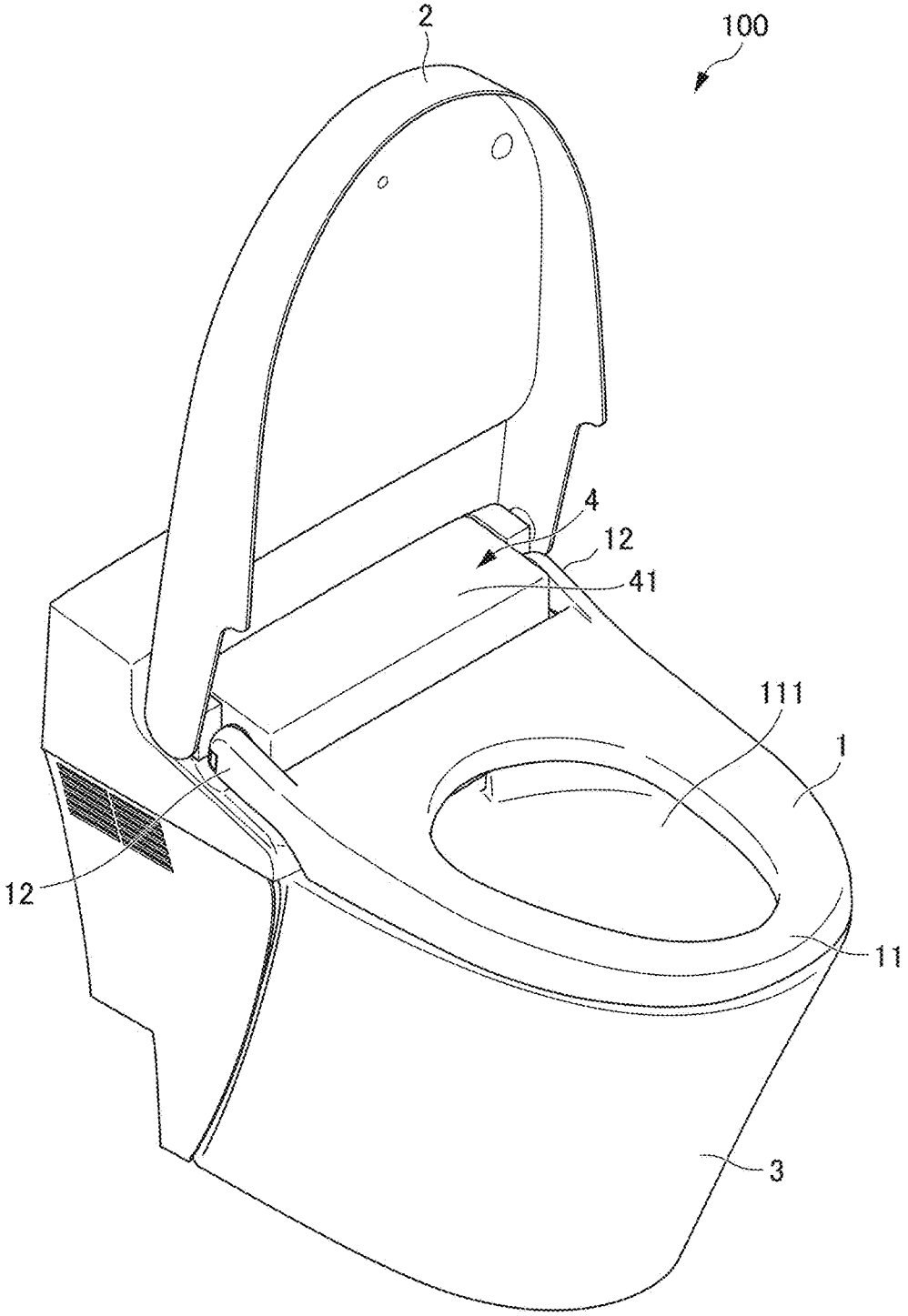
FIG. 1 is a perspective view illustrating a toilet seat device 100 including a toilet seat 1 according to an embodiment of the invention.

Hereinafter, a preferred embodiment of a toilet seat device 100 including a toilet seat 1 of the invention will be described with reference to drawings. In the present embodiment, a leftward and rightward direction in a case in which the toilet seat device 100 is viewed from a front (in a case of facing the toilet seat device 100) is referred to as a left-right direction, and a forward and rearward direction in the case in which the toilet seat device 100 is viewed from the front (in the case of facing the toilet seat device 100) is referred to as a front-rear direction. In addition, in the present embodiment, with regard to the toilet seat 1, in a case of being horizontally disposed above a toilet bowl 3, a side of a pair of hinges 12 is also referred to as a rear, and an opposite side from the pair of hinges 12 is also referred to as a front.

As illustrated in FIG. 1, the toilet seat device 100 of the present embodiment includes the toilet seat 1, a toilet lid 2, the toilet bowl 3, and a function part 4. The toilet seat 1 and the toilet lid 2 are attached to the toilet bowl 3 in an openable and closable manner above the toilet bowl 3. In the present embodiment, each of the toilet seat 1 and the toilet lid 2 is attached to a rotating shaft member (not illustrated) of an electric motor (not illustrated) and is configured to be rotatable by driving the electric motor (not illustrated).

The function part 4 is disposed above a rear portion of the toilet bowl 3. The function part 4 includes a function member (not illustrated) such as a cleaning tank (not illustrated), a hose (not illustrated), an electric motor (not illustrated), etc. and a cover member 41 that covers the function member.

Figure 2:
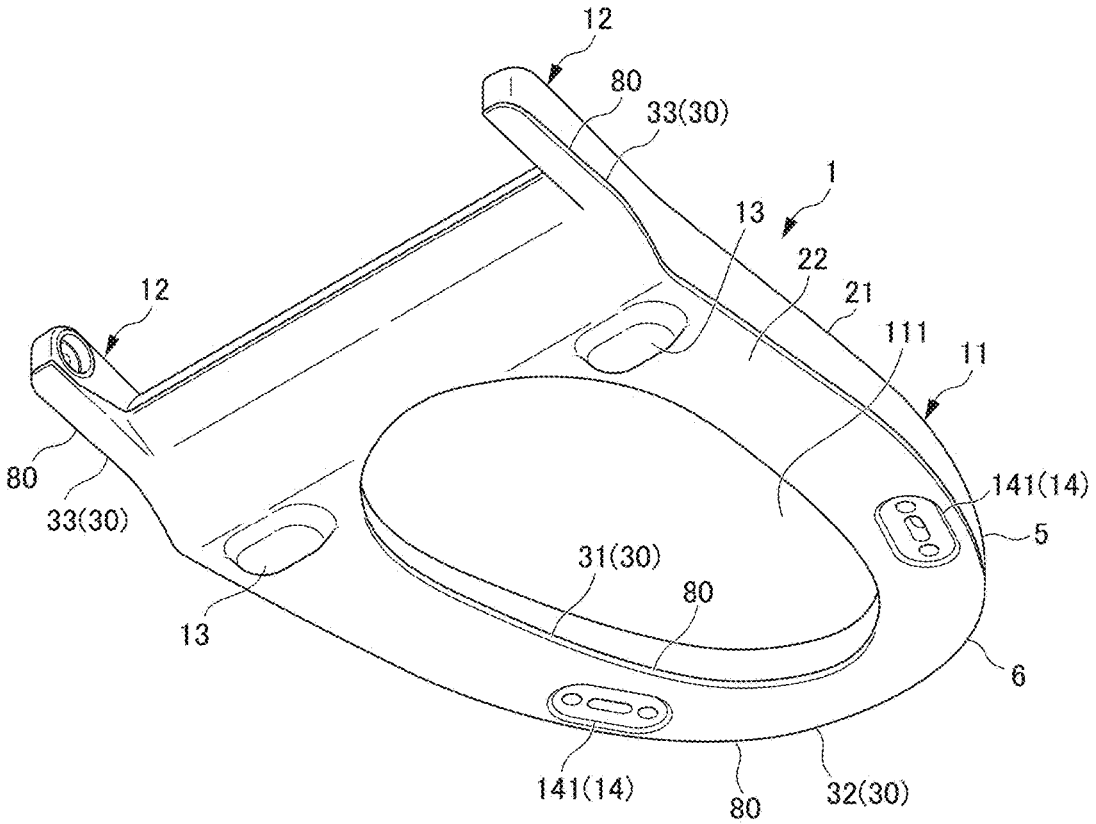
FIG. 2 is a perspective view illustrating the toilet seat 1 according to the embodiment of the invention.

The toilet seat 1 is disposed above the toilet bowl 3. As illustrated in FIG. 1 to FIG. 4, the toilet seat 1 includes a toilet seat main body 11, the pair of hinges 12, a pair of first leg portions 13 (protrusion), and a pair of second leg portions 14 (protrusion). The toilet seat main body 11 is formed in an oval shape in which an opening 111 is formed in a central portion. The pair of hinges 12 extends rearward from both ends of the toilet seat main body 11 on a rear side. As illustrated in FIG. 2, the toilet seat main body 11 includes a seat front portion 21 and a seat rear portion 22. The seat front portion 21 is included in an upper surface (front surface) side of the toilet seat 1. The seat rear portion 22 is included in a lower surface (rear surface) side of the toilet seat 1.

Figure 3:
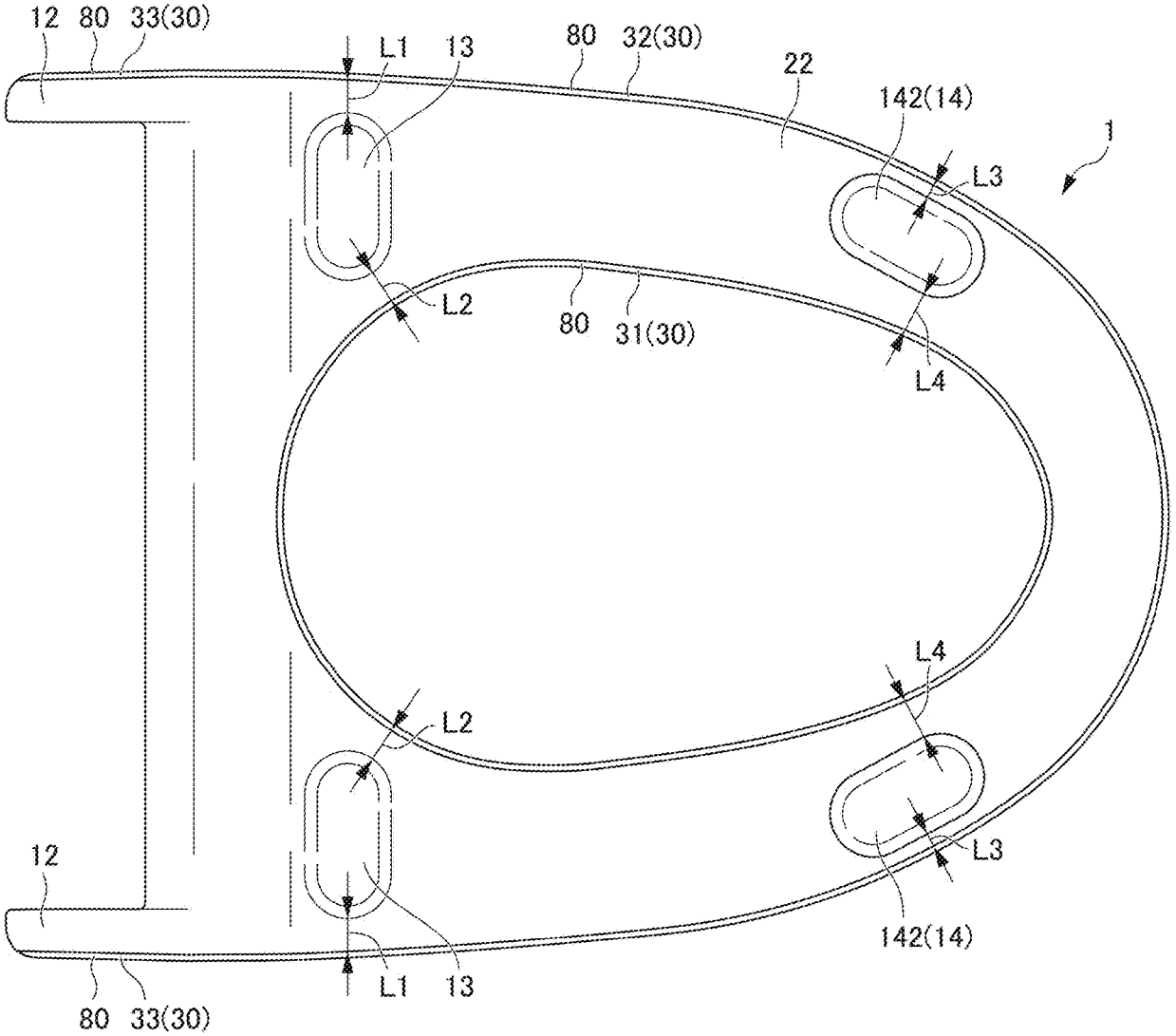
FIG. 3 is a diagram illustrating the toilet seat 1 according to the embodiment of the invention viewed from a side of a seat rear portion 22.
Figure 4:
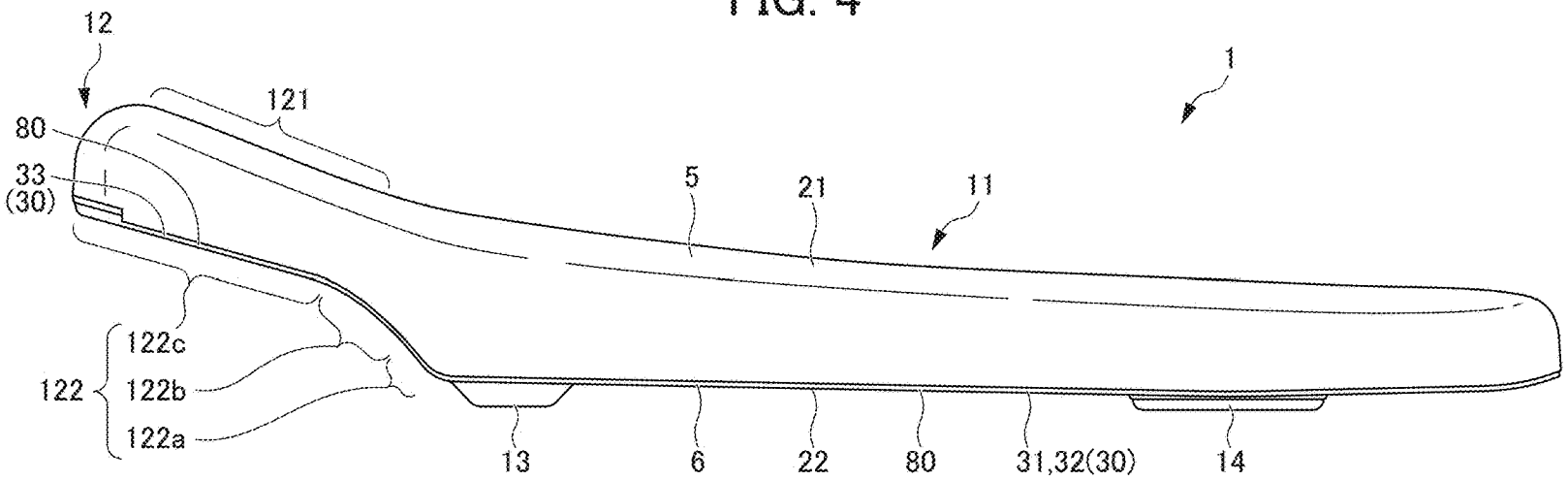
FIG. 4 is a side view illustrating the toilet seat 1 according to the embodiment of the invention.

As illustrated in FIG. 2 to FIG. 4, the pair of hinges 12 is disposed on end sides of the rear of the toilet seat 1, and is formed to extend to the rear of the toilet seat 1 from the both ends of the toilet seat main body 11 on the rear side. The pair of hinges 12 is rotatably attached to the cover member 41. As illustrated in FIG. 4, in side view, each of the hinges 12 includes an upper linear portion 121 and a lower line-shaped portion 122.

When the toilet seat device 100 is viewed from a side, the upper linear portion 121 linearly extends from an end of the toilet seat main body 11 on the rear side at an inclination angle of an upward inclination such that an angle formed with an upper portion of the toilet seat main body 11 is an obtuse angle in an upper part of the hinge 12.

When the toilet seat device 100 is viewed from the side, the lower line-shaped portion 122 upwardly extends from the end of the toilet seat main body 11 on the rear side such that an angle formed with a bottom portion of the toilet seat main body 11 is an obtuse angle and has a portion curved to be depressed upward in a lower part of the hinge 12.

The lower line-shaped portion 122 includes a first lower linear portion 122*a*, a lower curved portion 122*b*, and a second lower linear portion 122*c*. The first lower linear portion 122*a*, the lower curved portion 122*b*, and the second lower linear portion 122*c* are disposed in an order of the first lower linear portion 122*a*, the lower curved portion 122*b*, and the second lower linear portion 122*c* from an end on the toilet seat main body 11 side to an end on the opposite side from the toilet seat main body 11 in the lower part of the hinge 12.

The first lower linear portion 122*a* is formed in a linear shape on the end side on the toilet seat main body 11 side in the lower part of the hinge 12. The first lower linear portion 122*a* is inclined to rise to the end side on the opposite side from the toilet seat main body 11 in the hinge 12. The first lower linear portion 122*a* extends in a linear shape from the end of the toilet seat main body 11 on the rear side at an inclination angle of an upward inclination such that an angle formed with the bottom portion of the toilet seat main body 11 is an obtuse angle. When the toilet seat device 100 is viewed from the side, the lower curved portion 122*b* is curved to be depressed upward in the lower part of the hinge 12.

The lower curved portion 122*b* curves and extends to be depressed upward in the lower part of the hinge 12 from an end of the first lower linear portion 122*a* on the rear side. When the toilet seat device 100 is viewed from the side, the second lower linear portion 122*c* is formed in a linear shape at the end side on the opposite side from the toilet seat main body 11.

The second lower linear portion 122*c* is inclined to rise to the end side of the hinge 12 on the opposite side from the toilet seat main body 11. The second lower linear portion 122*c* linearly extends at an inclination angle of an upward inclination from an end of the lower curved portion 122*b* on the rear side such that an angle formed with the bottom portion of the toilet seat main body 11 is an obtuse angle smaller than the angle of the first lower linear portion 122*a*.

As illustrated in FIG. 2 to FIG. 4, the pair of first leg portions 13 and the pair of second leg portions 14 are disposed in the seat rear portion 22. The pair of first leg portions 13 and the pair of second leg portions 14 form leg portions coming into contact with the toilet bowl 3 when the toilet seat 1 is disposed above the toilet bowl 3 (see FIG. 1).

The first leg portions 13 are disposed on the side of the hinges 12 in the seat rear portion 22. The first leg portions 13 are formed to protrude from the seat rear portion 22. The first leg portions 13 are formed integrally with the seat rear portion 22 on the side of the hinges 12 in the seat rear portion 22. The first leg portions 13 extend by a predetermined length in the left-right direction of the toilet seat device 100 at a predetermined thickness.

As illustrated in FIG. 3, the first leg portions 13 are separated from an end of the toilet seat 1.

Figure 5:
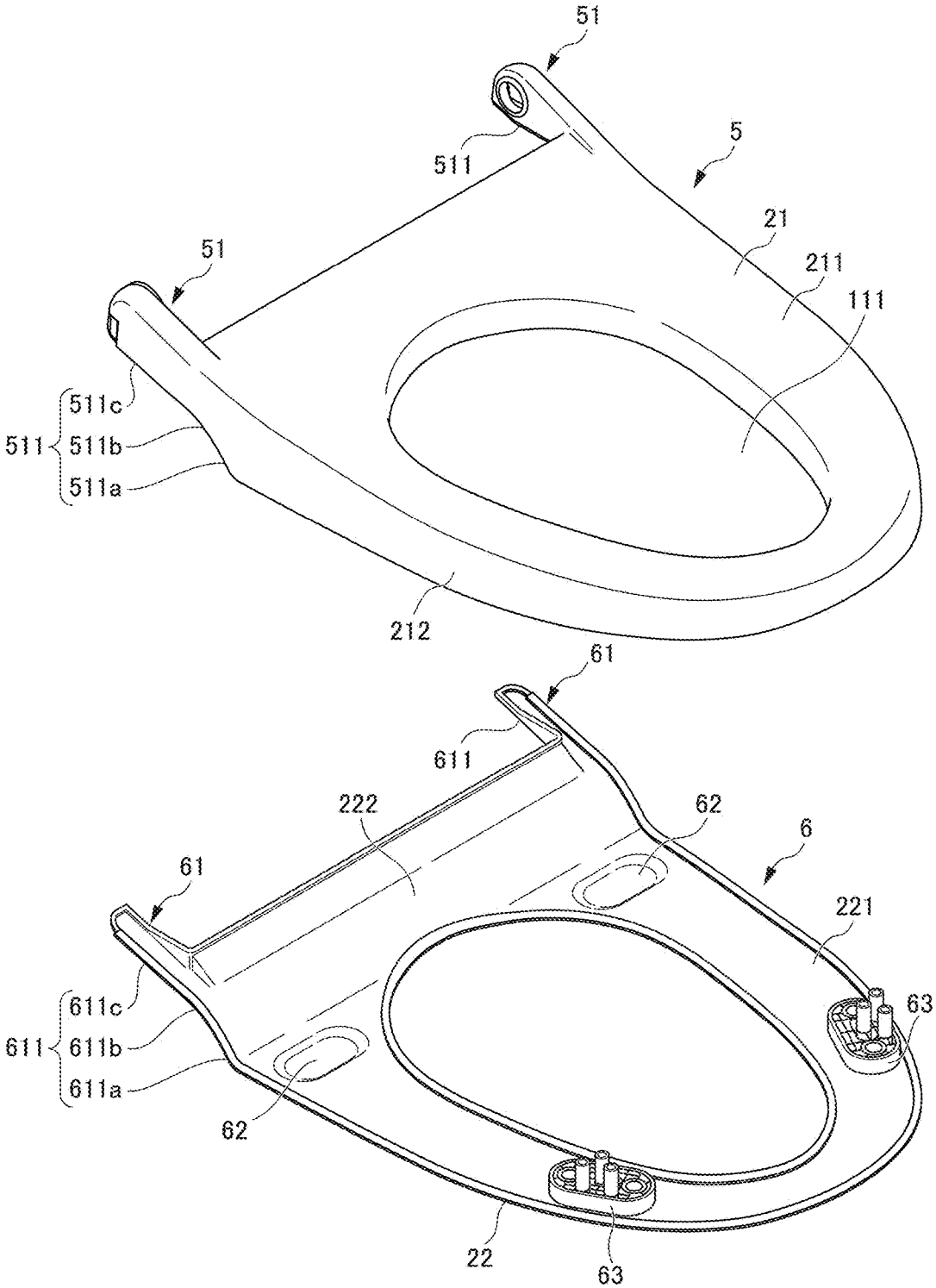
FIG. 5 is a perspective view illustrating a state before a seat front member 5 and a seat rear member 6 of the toilet seat 1 according to the present embodiment are combined together.

Here, as illustrated in FIG. 5, the toilet seat 1 is formed by joining the seat front member 5 and the seat rear member 6 together using welding. As illustrated in FIG. 2, the toilet seat 1 is manufactured by forming a cut surface 80 (processed surface) processed by cutting a joint part 30, which is formed by joining an edge of the seat front member 5 and an edge of the seat rear member 6 together using welding. For this reason, as illustrated in FIG. 3, an end of the cut surface 80 on the seat rear member 6 side and an end of the first leg portion 13 on the cut surface 80 side are preferably separated from each other by a predetermine distance or more so as not to come into contact with a cutting tool 70 (described below) at the time of cutting the joint part 30.

In the present embodiment, as illustrated in FIG. 3, with regard to the first leg portion 13, the end of the first leg portion 13 on the cut surface 80 side is away from the end of the cut surface 80 on the seat rear member 6 side by a first distance L1 on an outer peripheral edge side of the toilet seat 1, and the end of the first leg portion 13 on the cut surface 80 side is away from the end of the cut surface 80 on the seat rear member 6 side by a second distance L2 on an inner peripheral edge side of the toilet seat 1. For example, each of the first distance L1 and the second distance L2 is preferably 10 mm or more such that the joint part 30 does not come into contact with the cutting tool 70 (described below) at the time of cutting.

The second leg portions 14 are disposed on the opposite side from the hinges 12 in the seat rear portion 22. The second leg portions 14 protrude from the seat rear portion 22. Each of the second leg portions 14 includes a pedestal portion 141 (see FIG. 2) and a rubber foot portion 142 (see FIG. 3). The second leg portion 14 is configured by attaching the rubber foot portion 142 to the pedestal portion 141. In a state in which the rubber foot portion 142 is attached to the pedestal portion 141, the second leg portion 14 extends by a predetermined length along a curved shape of the toilet seat 1 at a predetermined thickness as illustrated in FIG. 3 on a front side of the seat rear portion 22 (the opposite side from the hinge 12).

In the present embodiment, as illustrated in FIG. 3, in the second leg portion 14, an end of the second leg portion 14 on the cut surface 80 side is away from an end of the cut surface 80 on the seat rear member 6 side by a third distance L3 on the outer peripheral edge side of the toilet seat 1, and the end of the second leg portion 14 on the cut surface 80 side is away from the end of the cut surface 80 on the seat rear member 6 side by a fourth distance L4 on the inner peripheral edge side of the toilet seat 1. Similarly to the above-described first leg portion 13, for example, each of the third distance L3 and the fourth distance L4 is preferably 10 mm or more such that the joint part 30 does not come into contact with the cutting tool 70 (described below) at the time of cutting.

As illustrated in FIG. 2, the pedestal portion 141 is formed integrally with the seat rear portion 22 on the front side of the seat rear portion 22 (the opposite side from the hinge 12). The pedestal portion 141 is included in a pedestal of the rubber foot portion 142, and the rubber foot portion 142 may be attached thereto. The pedestal portion 141 is formed in a frame shape extending by a predetermined length along the curved shape of the toilet seat 1. The rubber foot portion 142 is formed to extend by a predetermined length with a predetermined thickness so as to be attachable to the pedestal portion 141.

The above toilet seat 1 is connected to the function part 4 through the rotating shaft member (not illustrated), etc. of the electric motor inserted into the hinge 12. In this way, the toilet seat 1 is rotatably attached to the function part 4.

Figure 6:
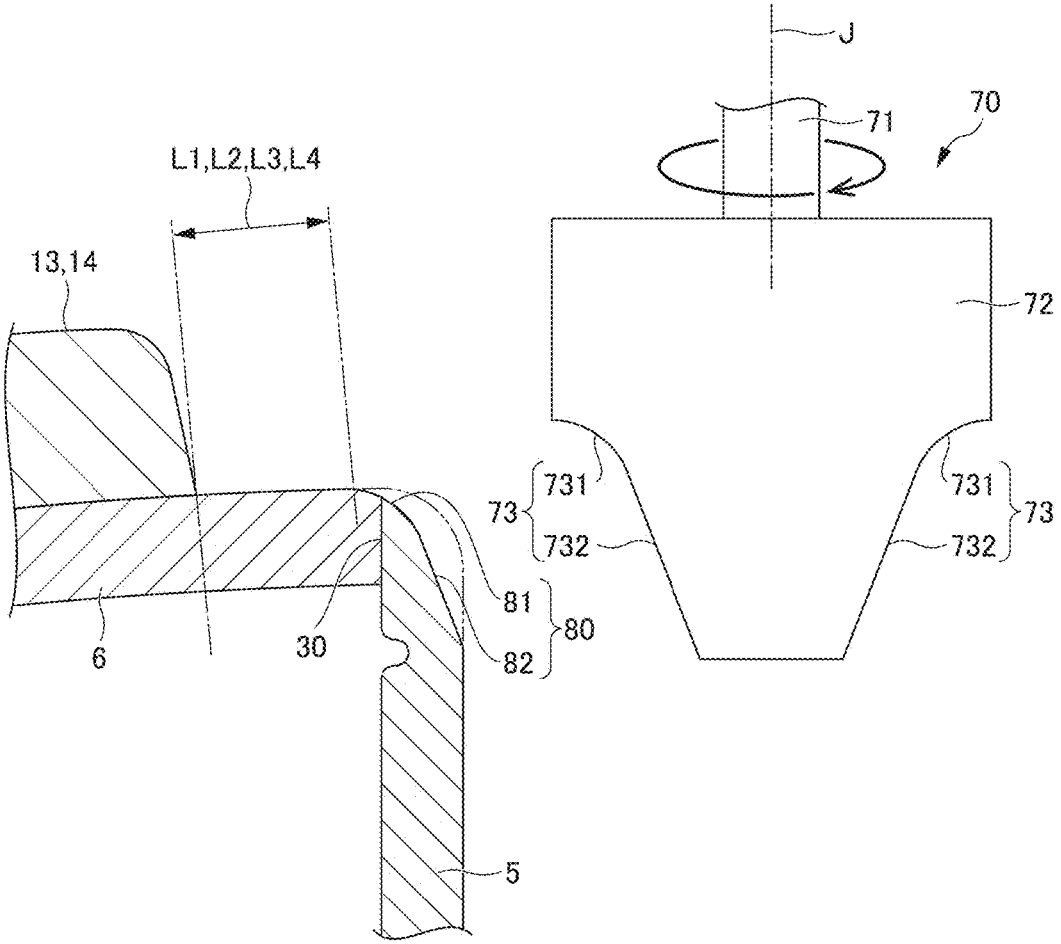
FIG. 6 is a diagram for description of a cutting tool 70 that cuts a joint part 30 in which the seat front member 5 and the seat rear member 6 are joined together.

In the present embodiment, as illustrated in FIG. 5, the toilet seat 1 is formed by joining the seat front member 5 and the seat rear member 6 together using welding. As illustrated in FIG. 2, the toilet seat 1 is manufactured by cutting the joint part 30 formed by joining the edge of the seat front member 5 and the edge of the seat rear member 6 together using welding. In the present embodiment, as illustrated in FIG. 2, the joint part 30 corresponds to an inner peripheral edge joint part 31 formed at the inner peripheral edge of the toilet seat 1, an outer peripheral edge joint part 32 formed at the outer peripheral edge of the toilet seat 1, and a hinge lower joint part 33 corresponding to the lower line-shaped portion 122 (see FIG. 4) of the hinge 12. In the present embodiment, as illustrated in FIG. 6, the seat front member 5 and the seat rear member 6 are combined at substantially orthogonal angles, and the edge of the seat front member 5 and the edge of the seat rear member 6 are joined by welding.

As illustrated in FIG. 5, the seat front member 5 is formed in an oval shape in which the opening 111 is formed in the central portion. The seat front member 5 includes the above-described seat front portion 21 and a pair of seat front side hinge components 51.

The seat front portion 21 includes a flat surface portion 211 slightly inclined downward toward the opening 111, and a side surface portion 212 extending downward by curving or bending to the rear surface side from an outer edge of the flat surface portion 211.

As illustrated in FIG. 5, the pair of seat front side hinge components 51 is formed to extend from the seat front portion 21 to a portion behind the seat front portion 21 at both ends of the seat front portion 21 in the left-right direction. In each of the seat front side hinge components 51, a seat front side hinge lower end 511 is formed in a lower part of the seat front member 5. The seat front side hinge lower end 511 corresponds to the above-described lower line-shaped portion 122 (see FIG. 4) of the hinge 12 in a state in which the seat front member 5 and the seat rear member 6 are joined together.

As illustrated in FIG. 5, the seat front side hinge lower end 511 includes a seat front side first lower linear portion 511*a*, a seat front side lower curved portion 511*b*, and a seat front side second lower linear portion 511*c*. The seat front side first lower linear portion 511*a*, the seat front side lower curved portion 511*b*, and the seat front side second lower linear portion 511*c* are formed in this order from the seat front portion 21 side. In the state in which the seat front member 5 and the seat rear member 6 are joined together, the seat front side first lower linear portion 511*a*, the seat front side lower curved portion 511*b*, and the seat front side second lower linear portion 511*c* correspond to the above-described first lower linear portion 122*a*, the above-described lower curved portion 122*b*, and the above-described second lower linear portion 122*c* (see FIG. 4), respectively, in side view.

As illustrated in FIG. 5, the seat rear member 6 is formed in an oval shape in which the opening 111 is formed in the central portion. The seat rear member 6 includes the above-described seat rear portion 22, a pair of seat rear side hinge components 61, a pair of first leg portion components 62 included in the above-described pair of first leg portions 13, and a pair of second leg portion pedestal components 63 included in the pedestal portions 141 of the above-described pair of second leg portions 14.

The seat rear portion 22 includes a flat surface portion 221 and an inclined portion 222. The flat surface portion 211 is formed in a planar shape on the front side. The inclined portion 222 is inclined upward such that an angle formed with the seat rear portion 22 is an obtuse angle and is curved to be convex upward and extends from an edge of the flat surface portion 221 at the rear (the hinge 12 side) of the seat rear portion 22.

As illustrated in FIG. 5, the pair of seat rear side hinge components 61 is formed to extend from the seat rear portion 22 to a portion behind the seat rear portion 22 at both ends of the seat rear portion 22 in the left-right direction. In the seat rear side hinge component 61, a seat rear side hinge side edge end 611 is formed at a side edge of the seat rear member 6. The seat rear side hinge side edge end 611 corresponds to the above-described lower line-shaped portion 122 (see FIG. 4) of the hinge 12 in the state in which the seat front member 5 and the seat rear member 6 are joined together.

The seat rear side hinge side edge end 611 includes a seat rear side first lower linear portion 611*a*, a seat rear side lower curved portion 611*b*, and a seat rear side second lower linear portion 611*c*. In the seat rear side hinge side edge end 611, the seat rear side first lower linear portion 611*a*, the seat rear side lower curved portion 611*b*, and the seat rear side second lower linear portion 611*c* are formed in this order from the seat rear portion 22 side. In the state in which the seat front member 5 and the seat rear member 6 are joined together, the seat rear side first lower linear portion 611*a*, the seat rear side lower curved portion 611*b*, and the seat rear side second lower linear portion 611*c* correspond to the above-described first lower linear portion 122*a*, the above-described lower curved portion 122*b*, and the above-described second lower linear portion 122*c* (see FIG. 4), respectively, in side view.

The seat front member 5 and the seat rear member 6 are formed by injection-molding a synthetic resin material such as polypropylene using a mold. In the present embodiment, the toilet seat 1 is formed when the edge of the seat front member 5 and the edge of the seat rear member 6 are brought into contact with each other and welded to form the joint part 30, and then a portion of the joint part 30 formed by welding the seat front member 5 and the seat rear member 6 is cut to form the cut surface 80 (see FIG. 6) serving as a processed surface.

Referring to a shape of the cut surface 80 of the joint part between the seat front member 5 and the seat rear member 6, as illustrated in FIG. 6, in a cross section perpendicular to a direction in which the joint part 30 extends, the seat rear member 6 side is formed in a curved shape that protrudes outward, and the seat front member 5 side is formed in a linear shape. The direction in which the joint part 30 extends refers to a direction along the edge of the seat front member 5 and the edge of the seat rear member 6 in the state in which the edge of the seat front member 5 and the edge of the seat rear member 6 are joined together.

The cutting tool 70 is used when the joint part 30 between the seat front member 5 and the seat rear member 6 is cut. As illustrated in FIG. 6, the cutting tool 70 includes a cutting rotary shaft member 71 that rotates around a rotation axis J and a rotary blade member 72 fixed to one end of the cutting rotary shaft member.

The rotary blade member 72 includes a plurality of cutting blades 73 and is configured to be rotatable around the rotation axis J. The plurality of cutting blades 73 is disposed in parallel with each other at an interval of a predetermined angle along a rotation direction in the rotary blade member 72. Each of the plurality of cutting blades 73 is formed in the same shape.

As illustrated in FIG. 6, the cutting blade 73 includes a curved cutting blade part 731 and a linear cutting blade part 732. The curved cutting blade part 731 and the linear cutting blade part 732 are continuously formed.

The curved cutting blade part 531 is depressed in an arc shape. For example, a radius of curvature R of an arc-shaped portion is preferably in a range of 3 to 7 mm (3R to 7R, a circular arc having a radius of 3 to 7 mm), and more preferably 5 mm (5R, a circular arc having a radius of 5 mm).

A central angle of the arc shape of the curved cutting blade part 731 is preferably a predetermined central angle or less. The predetermined central angle refers to a central angel at which an end of the arc shape of the curved cutting blade part 731 does not come into contact with a portion not cut by the cutting tool 70. For example, when the seat front member 5 and the seat rear member 6 are combined at angles substantially perpendicular to each other, the central angle of the arc shape of the curved cutting blade part 731 is preferably 90 degrees or less.

The curved cutting blade part 731 is formed such that ends of the curved cutting blade part 731 on the sides of the first leg portion 13 and the second leg portion 14 are away from ends of the first leg portion 13 and the second leg portion 14 on the cut surface 80 side by the first distance L1, the second distance L2, the third distance L3, or the fourth distance L4 or more (for example, 10 mm or more) during the cutting step.

The curved cutting blade part 731 cuts the joint part 30, the seat rear member 6, and the seat front member 5 while being disposed on the seat rear member 6 side. A cut surface cut by the curved cutting blade part 731 becomes a curved cut surface 81 serving as a processed surface. The curved cut surface 81 is formed to extend in a curved shape of a circular arc which protrudes outward on the seat rear member 6 side.

The linear cutting blade part 732 linearly extends from an end of the curved cutting blade part 731 at a predetermined inclination angle at which the rotation axis J is approached as being away from the curved cutting blade part 731.

The linear cutting blade part 732 cuts the seat front member 5 on the seat front member 5 side of the joint part 30 while being disposed on the seat front member 5 side. A cut surface cut by the linear cutting blade part 732 becomes a linear cut surface 82 serving as a processed surface. The linear cut surface 82 smoothly continues from the curved cut surface 81, and the seat front member 5 side thereof is formed in a linear shape. The linear cut surface 82 is formed to linearly extend at an inclination angle at which the linear cut surface 82 approaches a surface of the seat front member 5 as the linear cut surface 82 is away from the seat rear member 6.

Here, a description will be given of the cutting step in the method of manufacturing the toilet seat 1 of the present embodiment with reference to FIG. 7.

Figure 7:
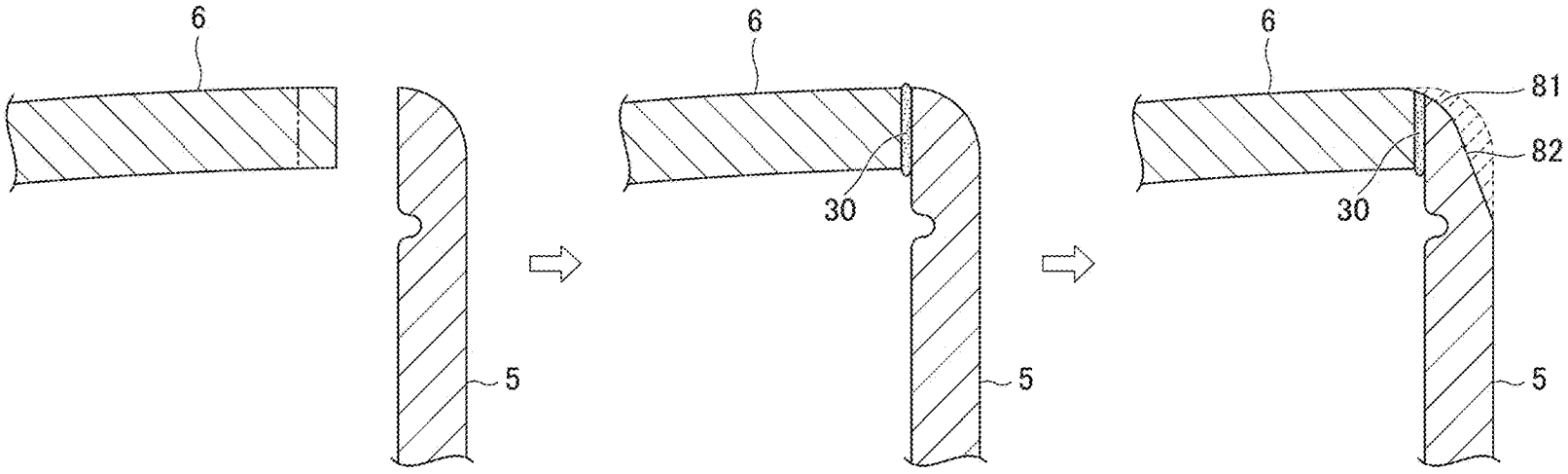
FIG. 7 is a diagram illustrating a cutting step for the toilet seat 1, and is a cross-sectional view illustrating a cross section in a direction perpendicular to a direction in which the joint part 30 extends.

When the toilet seat 1 is manufactured, as illustrated in FIG. 7, first, after the seat front member 5 and the seat rear member 6 are welded by a welding machine (not illustrated) to form the joint part 30, the cutting step is executed. In the present embodiment, the seat front member 5 and the seat rear member 6 are combined at angles substantially perpendicular to each other, and the edge of the seat front member 5 and the edge of the seat rear member 6 are joined by welding.

In the cutting step, a portion of the joint part 30 is cut together with the seat front member 5 and the seat rear member 6. In the present embodiment, using the cutting tool 70 (see FIG. 6), the cutting blade 73 including the curved cutting blade part 731 and the linear cutting blade part 732 is rotated to cut and remove the seat rear member 6 side in an arc shape and cut and remove the seat front member 5 side in an inclined linear shape as illustrated in FIG. 7, thereby cutting the joint part 30 together with the seat front member 5 and the seat rear member 6. In this way, as illustrated in FIG. 6, in the joint part 30, as the cut surface 80, the curved cut surface 81 is formed on the seat rear portion side, and the linear cut surface 82 is formed on the seat front portion side.

Then, in this state, the cutting tool 70 is moved along the direction in which the joint part 30 extends.

With regard to the toilet seat main body 11, as illustrated in FIG. 2 and FIG. 4, the cutting tool 70 is horizontally moved along a circumferential direction in each of the inner peripheral edge joint part 31 and the outer peripheral edge joint part 32 of the toilet seat main body 11. That is, in the inner peripheral edge joint part 31 and the outer peripheral edge joint part 32 in the toilet seat main body 11, the cutting tool 70 is moved in a linear direction in side view.

In addition, in the hinge lower joint part 33 of the hinge 12, as illustrated in FIG. 2 and FIG. 4, the cutting tool 70 is moved in an order of the first lower linear portion 122*a*, the lower curved portion 122*b*, and the second lower linear portion 122*c*. That is, in the lower part of the hinge 12, in side view, the cutting tool 70 is moved in an order of a linear direction in the first lower linear portion 122*a*, a curve direction in the lower curved portion 122*b*, and a linear direction in the second lower linear portion 122*c*. Even though the cutting tool 70 is moved and cut in the order of the first lower linear portion 122*a*, the lower curved portion 122*b*, and the second lower linear portion 122*c* in the present embodiment, the invention is not limited thereto, and the cutting tool 70 may be moved and cut in an order of the second lower linear portion 122*c*, the lower curved portion 122*b*, and the first lower linear portion 122*a*.

Here, in the hinge lower joint part 33 of the hinge 12, as illustrated in FIG. 4, the first lower linear portion 122*a*, the lower curved portion 122*b*, and the second lower linear portion 122*c* are disposed in this order.

Conventionally, in a case in which the cutting tool 70 is moved along the joint part 30 to cut a curved portion, and the curved portion is included, when cutting starts from the curved portion, a processing trace has been left on a processed surface, and the processed surface could not be cleanly formed. For this reason, a linear processed surface has been formed without forming the curved portion. Therefore, in the present embodiment, the processed surface is formed by disposing the first lower linear portion 122*a*, the lower curved portion 122*b*, and the second lower linear portion 122*c* in this order such that cutting starts from a linear portion and cutting ends in the linear portion. That is, in the hinge lower joint part 33 of the hinge 12, a moving direction of the cutting tool 70 is set to the order of the linear direction (the first lower linear portion 122*a*), the curve direction (the lower curved portion 122*b*), and the linear direction (the second lower linear portion 122*c*) in side view.

Through the above step, the toilet seat 1 may be manufactured by executing the cutting step on the joint part 30 in which the seat front member 5 and the seat rear member 6 are welded. In this way, the shape of the cut surface 80 of the joint part 30 may be set to a smooth shape in the joint part 30.

According to the toilet seat 1 and the method of manufacturing the toilet seat 1 of the present embodiment described above, the following effects are obtained.

In the toilet seat 1 of the present embodiment, referring to the shape of the cut surface 80 of the joint part 30 between the seat front member 5 and the seat rear member 6, in the cross section perpendicular to the direction in which the joint part 30 extends, the seat rear member 6 side is formed in the curved shape that protrudes outward, and the seat front member 5 side is formed in the linear shape.

For this reason, on the seat rear member 6 side, when the seat rear member 6 side is formed in the curved shape that protrudes outward, the shape of the cut surface 80 of the joint part 30 may be set to the smooth shape in the joint part 30. In this way, even when a user touches the cut surface 80 with a hand, it is possible to improve quality without the hand being caught. In particular, the user has a lot of opportunities to touch the seat rear member 6 side of the toilet seat 1. For this reason, the effect of the invention that the joint part 30 can be formed in the smooth cut surface 80 on the seat rear member 6 side is large.

In addition, since the smooth cut surface 80 can be formed, polishing using paper, etc. is unnecessary after the cut surface 80 is formed. For this reason, it is possible to ensure the thickness of the joint part 30 of the toilet seat when compared to a case in which polishing is performed after cutting. In this way, it is possible to improve strength of the joint part 30.

In addition, the method of manufacturing the toilet seat 1 in the present embodiment includes the cutting step of forming the cut surface 80 by cutting the joint part 30 between the seat front member 5 and the seat rear member 6 using the cutting tool 70 including the curved cutting blade part 731 such that the shape of the cut surface 80 of the joint part 30 between the seat front member 5 and the seat rear member 6 is formed in the curved shape in which the seat rear member 6 side protrudes outward in the cross section perpendicular to the direction in which the joint part 30 extends. In this way, the smooth cut surface 80 can be formed, and thus polishing using paper, etc. is unnecessary after the cut surface 80 is formed. Therefore, it is possible to reduce the number of man hours at the time of manufacturing the toilet seat 1. Accordingly, it is possible to improve productivity of the toilet seat 1.

In addition, in the method of manufacturing the toilet seat 1 in the present embodiment, the seat rear member 6 includes the first leg portion 13 and/or the second leg portion 14 protruding from the seat rear portion 22 of the seat rear member 6 included in the rear surface of the toilet seat 1, and the curved cutting blade part 731 is formed such that the ends of the curved cutting blade part 731 on the sides of the first leg portion 13 and/or the second leg portion 14 are away from the ends of the first leg portion 13 and/or the second leg portion 14 on the cut surface 80 side by 10 mm or more during the cutting step.

In this way, when the joint part 30 is cut, the joint part 30 may be cut in a state in which the cutting tool 70 does not come into contact with the first leg portion 13 or the second leg portion 14. In addition, it is possible to inhibit the first leg portion 13 or the second leg portion 14 from being cut by the cutting tool 70. Therefore, when the seat rear member 6 in which the first leg portion 13 or the second leg portion 14 is formed is used, it is possible to improve productivity of the toilet seat 1 without the first leg portion 13 or the second leg portion 14 becoming an obstacle.

Even though a preferred embodiment of the toilet seat of the invention has been described above, the invention is not limited to the above-described embodiment, and can be changed as appropriate. For example, in the present embodiment, the shape of the cut surface 80 of the joint part 30 between the seat front member 5 and the seat rear member 6 is formed in the curved shape in which the seat rear member 6 side protrudes outward. For example, the curved shape in which the seat rear member 6 side protrudes outward may be formed by a perfect circle-shaped circular arc, formed by an elliptical circular arc, or formed by another smooth curved line.

In addition, even though the joint part is joined by welding in the present embodiment, the invention is not limited thereto. For example, the joint part may be joined by bonding.

EXPLANATION OF REFERENCE NUMERALS

1 toilet seat
5 seat front member
6 seat rear member
13 first leg portion (protrusion)
14 second leg portion (protrusion)
22 seat rear portion
30 joint part

70 cutting tool
80 cut surface (processed surface)
731 curved cutting blade part
732 linear cutting blade part

The invention claimed is:

1. A method of manufacturing a toilet seat formed by joining a seat front member and a seat rear member together, the method comprising a cutting step of forming a processed surface of a joint part between the seat front member and the seat rear member by cutting the seat front member and the seat rear member at the joint part between the seat front member and the seat rear member using a cutting tool including a curved cutting blade part such that a shape of the processed surface is formed in a curved shape in which a side of the seat rear member protrudes outward in a cross section perpendicular to a direction in which the joint part extends.

2. The method of manufacturing a toilet seat of claim 1, wherein the seat rear member has a protrusion protruding from a seat rear portion of the seat rear member included in a rear surface of the toilet seat, and the curved cutting blade part is formed such that an end of the curved cutting blade part on a side of the protrusion is away from an end of the protrusion on a side of the processed surface by 10 mm or more during the cutting step.

* * * * *